US012188320B2

(12) United States Patent
Trinh et al.

(10) Patent No.: US 12,188,320 B2
(45) Date of Patent: Jan. 7, 2025

(54) DOWNHOLE FRICTION REDUCTION SYSTEMS HAVING A FLEXIBLE AGITATOR

(71) Applicant: National Oilwell Varco, L.P., Houston, TX (US)

(72) Inventors: Khoi Trinh, Spring, TX (US); Russell Gilleylen, Spring, TX (US)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 18/408,130

(22) Filed: Jan. 9, 2024

(65) Prior Publication Data

US 2024/0183240 A1 Jun. 6, 2024

Related U.S. Application Data

(63) Continuation of application No. 17/837,780, filed on Jun. 10, 2022, now Pat. No. 11,905,777.

(51) Int. Cl.
*E21B 31/00* (2006.01)
*E21B 34/10* (2006.01)

(52) U.S. Cl.
CPC ..... *E21B 31/005* (2013.01); *E21B 34/10* (2013.01)

(58) Field of Classification Search
CPC ..... E21B 31/005; E21B 34/10
See application file for complete search history.

(56) References Cited

U.S. PATENT DOCUMENTS

2019/0234178 A1* 8/2019 Panda ..... B23H 9/00
2020/0056451 A1* 2/2020 Chambers ..... E21B 21/10

* cited by examiner

*Primary Examiner* — Dany E Akakpo
(74) *Attorney, Agent, or Firm* — Conley Rose, P.C.

(57) ABSTRACT

An agitator deployable in a wellbore includes a housing, a valve disposed in the housing and including a first valve body and a second valve body permitted to rotate relative to the first valve body, a first valve adapter coupled to the housing and which includes a first receptacle which receives at least a portion of the first valve body, wherein the first receptacle includes a cylindrical inner surface and an annular shoulder projecting radially inwards from the cylindrical inner surface, and a flexible valve seat positioned in the first receptacle of the first valve adapter between the first valve body and the first valve adapter, wherein the flexible valve seat has a cylindrical portion and an annular shoulder extending radially inwards from the cylindrical portion.

20 Claims, 7 Drawing Sheets

DOWNHOLE FRICTION REDUCTION SYSTEMS HAVING A FLEXIBLE AGITATOR

CROSS-REFERENCE TO RELATED APPLICATIONS

The present application is a continuation of U.S. non-provisional patent application Ser. No. 17/837,780 filed Jun. 10, 2022, entitled "Downhole Friction Reduction Systems Having a Flexible Agitator", which is incorporated herein in its entirety for all purposes.

STATEMENT REGARDING FEDERALLY SPONSORED RESEARCH OR DEVELOPMENT

Not applicable.

BACKGROUND

In drilling a wellbore into an earthen formation, such as for the recovery of hydrocarbons or minerals from a subsurface formation, it is typical practice to connect a drill bit onto the lower end of a drillstring formed from a plurality of pipe joints connected together end-to-end, and then rotate the drillstring so that the drill bit progresses downward into the earth to create a wellbore along a predetermined trajectory. In some applications, drilling fluid or "mud" is pumped under pressure down the drillstring, out the face of the drill bit into the wellbore, and then up the annulus between the drillstring and the wellbore sidewall to the surface. The drilling fluid, which may be water-based or oil-based, is typically viscous to enhance its ability to carry wellbore cuttings to the surface. Additionally, the drillstring may be connected to a bottomhole assembly (BHA) including a downhole mud motor configured to rotate drill bit in response to the pumping of the pressurized drilling fluid.

The drillstring may not be rotated from the surface in some instances when rotation of the drill bit is driven by the mud motor, and instead the drillstring may slide through the wellbore as the drill bit cuts into the formation. The drillstring may form what is referred to as a "mud cake" along a sidewall of the wellbore which provides a physical barrier between the wellbore and the earthen formation to reduce fluid loss to the earthen formation. Additionally, portions of the drillstring may occasionally "stick" a sidewall of the wellbore as the drillstring slides through the wellbore, undesirably increasing the amount of friction between the drillstring and the wellbore which may limit the "reach" or length of the wellbore. In some applications, the drillstring is provided with one or more friction reduction tools designed to reduce friction between the drillstring and the wellbore. The friction reduction tools may be configured to generate oscillating motion in the drillstring in response to periodically obstructing or choking the flow of drilling fluid to the BHA.

BRIEF SUMMARY

An embodiment of an agitator deployable in a wellbore comprises a housing comprising a central axis and a central passage, a valve disposed in the housing and comprising a first valve body having a first contact face and a second valve body permitted to rotate relative to the first valve body and having a second contact face configured to contact the first contact face, a first valve adapter coupled to the housing and which comprises a first receptacle which receives at least a portion of the first valve body to couple the first valve adapter to the first valve body, wherein the first receptacle comprises a cylindrical inner surface and an annular shoulder projecting radially inwards from the cylindrical inner surface, and a flexible valve seat positioned in the first receptacle of the first valve adapter between the first valve body and the first valve adapter, wherein the flexible valve seat has a cylindrical portion positioned radially between the first valve body and the cylindrical inner surface of the first receptacle and an annular shoulder extending radially inwards from the cylindrical portion and that is positioned axially between a longitudinal end of the first valve body and the annular shoulder of the first receptacle. In some embodiments, the agitator comprises a stator positioned in the housing, and a rotor rotatably positioned in the stator and connected to one of the first valve body and the second valve body. In some embodiments, the flexible valve seat is formed from an elastomeric material. In certain embodiments, the flexible valve seat is formed from a material having a durometer rating on the Shore A Hardness scale between 40 and 120. In certain embodiments, the flexible valve seat seals the connection formed between the first valve body and the first valve adapter. In some embodiments, the agitator comprises a second valve adapter coupled to the housing and which comprises a second receptacle which receives at least a portion of the second valve body to couple the second valve adapter to the second valve body, wherein the flexible valve seat comprises a first flexible valve seat and the agitator further comprises a second flexible valve seat positioned in the second receptacle of the second valve adapter and which seals the connection formed between the second valve body and the second valve adapter. In some embodiments, the cylindrical portion of the flexible valve seat has a cylindrical inner surface that tapers in diameter along the longitudinal length of the cylindrical portion. In certain embodiments, the cylindrical portion of the flexible valve seat tapers such that an inner diameter of the inner surface of the flexible valve seat decreases moving from an uphole end of the flexible valve seat towards a downhole end of the flexible valve seat.

An embodiment of an agitator deployable in a wellbore comprises a housing comprising a central axis and a central passage, a valve disposed in the housing and comprising a first valve body having a first contact face and a second valve body permitted to rotate relative to the first valve body and having a second contact face configured to contact the first contact face, a first valve adapter coupled to the housing and which comprises a first receptacle which receives at least a portion of the first valve body to couple the first valve adapter to the first valve body, and a flexible valve seat positioned in the first receptacle of the first valve adapter between the first valve body and the first valve adapter and wherein the flexible valve seat comprises a body formed from a first material having a first hardness and a spacer ring embedded in the body of the flexible valve seat that is formed from a second material having a second hardness that is greater than the first hardness. In certain embodiments, the material of the body of the flexible valve seat has a durometer rating on the Shore A Hardness scale between 70 and 90. In some embodiments, the agitator comprises a stator positioned in the housing, and a rotor rotatably positioned in the stator and connected to one of the first valve body and the second valve body. In some embodiments, the flexible valve seat seals the connection formed between the first valve body and the first valve adapter. In certain embodiments, the spacer ring extends entirely around the first valve body and is oriented in a direction parallel a central axis of the first valve body. In certain embodiments, the spacer ring restricts the first valve body from becoming laterally offset from the first valve adapter such that a central axis of the first valve body is laterally spaced from a central axis of the first valve adapter. In some embodiments, the first receptacle of the first valve adapter comprises a cylindrical inner surface and an annular shoulder projecting radially inwards from the cylindrical inner surface, and the flexible valve seat has a cylindrical portion positioned radially between the first valve body and the cylindrical inner surface of the first receptacle and an annular shoulder extending radially inwards from the cylindrical portion and that is positioned axially between a longitudinal end of the first valve body and the annular shoulder of the first receptacle.

An embodiment of an agitator deployable in a wellbore comprises a housing comprising a central axis and a central passage, a valve disposed in the housing and comprising a first valve body having a first contact face and a second valve body permitted to rotate relative to the first valve body and having a second contact face configured to contact the first contact face, a first valve adapter coupled to the housing and which comprises a first receptacle which receives at least a portion of the first valve body to couple the first valve adapter to the first valve body, wherein the first receptacle comprises a cylindrical inner surface and an annular shoulder projecting radially inwards from the cylindrical inner surface, and a flexible valve seat positioned in the first receptacle of the first valve adapter entirely between a longitudinal end of the first valve body and the annular shoulder of the first receptacle. In some embodiments, the agitator comprises a stator positioned in the housing, and a rotor rotatably positioned in the stator and connected to one of the first valve body and the second valve body. In certain embodiments, the flexible valve seat comprises a mechanical biasing member configured to apply a biasing force to the longitudinal end of the first valve body. In certain embodiments, the flexible valve seat comprises a wave spring. In some embodiments, the flexible valve seat is trapped axially between the longitudinal end of the first valve body and the annular shoulder of the first receptacle.

BRIEF DESCRIPTION OF THE DRAWINGS

For a detailed description of disclosed embodiments, reference will now be made to the accompanying drawings in which.

DETAILED DESCRIPTION OF DISCLOSED EMBODIMENTS

Figure 1:
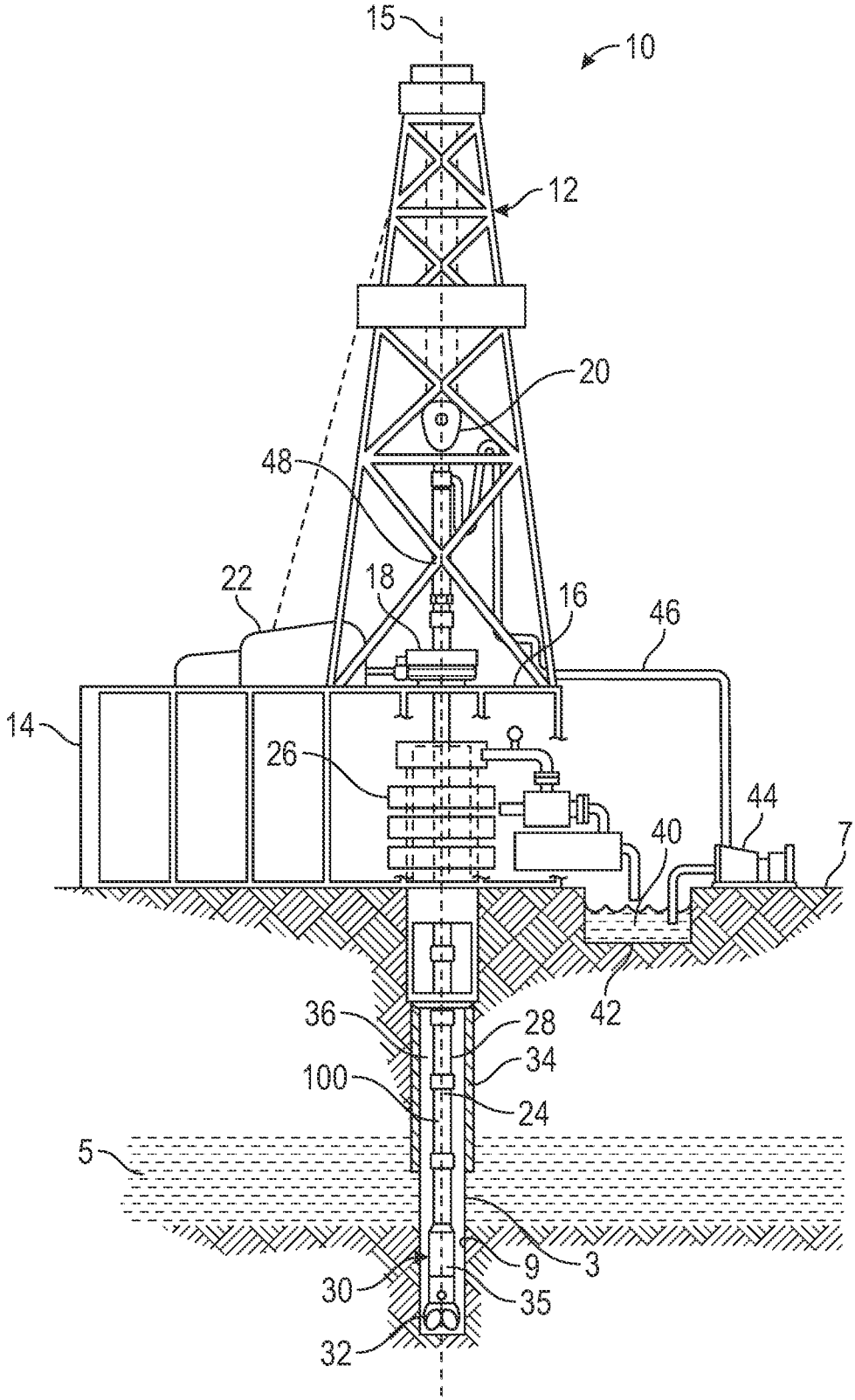
FIG. 1 is a schematic view of a drilling system including an agitator according to some embodiments.

The following discussion is directed to various embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection as accomplished via other devices, components, and connections. In addition, as used herein, the terms "axial" and "axially" generally mean along or parallel to a central axis (for example, central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the wellbore and with "down", "lower", "downwardly", "downhole", or "downstream" meaning toward the terminal end of the wellbore, regardless of the wellbore orientation.

As described previously, friction reduction tools may at times be utilized to reduce friction between a drillstring and a sidewall of a wellbore. Particularly, the friction reduction tool may induce oscillatory motion in the drillstring in an effort to break static friction and prevent the drillstring from sticking to the sidewall of the wellbore. Conventional friction reduction tools may comprise an agitator and an oscillator or shock tool positioned upstream of the agitator (for example, between the agitator and an upper end of the drillstring at the surface). The agitator may include a valve which periodically and abruptly obstructs or chokes the flow of drilling fluid through the agitator, thereby creating a pressure pulse within the drilling fluid which travels upstream to the shock tool. The shock tool may include a spring-loaded mandrel which may extend in response to the application of the pressure pulse against the mandrel and which may also retract in response to a biasing force applied against the mandrel by a biasing member of the shock tool after the pressure pulse has dissipated. Accordingly, the shock tool may periodically axially extend and retract in response to the periodic application of pressure pulses within the drilling fluid induced by the agitator positioned downstream from the shock tool. The axial oscillatory motion induced in the shock tool may be communicated to the drillstring coupled to the shock tool to inhibit the drillstring from sticking to the sidewall of the wellbore.

Downhole agitators may include a pair of valve plates or bodies which form a metal-to-metal seal therebetween to periodically open and close flow passages formed in the pair of valve bodies as the pair of valve bodies rotate relative to each other. In this manner, the pair of valve bodies may continually actuate the agitator between open and closed configurations as the pair of valve bodies continue to rotate relative each other. For example, a first valve body of the pair of valve bodies may be connected to a rotor of a rotor-and-stator arrangement and thus may rotate relative to a second valve body of the pair of valve bodies in response to the flow of drilling fluid through the agitator.

Often, the first or rotating valve body is angularly misaligned with respect to the second or stationary valve body resulting in only a small portion of a contact or sealing surface of the rotating valve body contacting a corresponding contact or sealing surface of the stationary valve body. In other words, a central axis of the rotating valve body may be at a non-zero angle relative to a central axis of the stationary valve body as the rotating valve body slidingly engages the stationary valve body.

Given manufacturing tolerances and other practicalities it may be exceedingly difficult to produce an agitator in which the pair of valve bodies remain in substantial angular alignment during the operation of the agitator. For example, it is typical for a stator liner of the rotor-and-stator arrangement to have an offset from centerline that varies along the length of the stator liner. Given that the stator liner orients and positions the rotor relative to a stator housing in which the stator liner is positioned, the offset in the stator liner produces an angular misalignment between the central axis of the rotating valve body and both the central axis of the stator housing and the central axis of the stationary valve body which is typically connected to and aligned with the stator housing. The angular misalignment produced between the pair of valve bodies results in significantly elevated point loads to which the relatively brittle pair of valve bodies are susceptible to fracture. Thus, the elevated point loads imparted to the pair of valve bodies due to the angular misalignment therebetween may potentially damage or otherwise minimize the operational life of the pair of valve bodies.

Accordingly, embodiments of agitators and friction reduction systems are described herein which include a pair of valve plates or bodies where at least one of which is coupled to a flexible valve seat to permit the valve body to flex relative to a housing (e.g., a stator housing) of the agitator. The flexible valve seat may comprise a flexible material such as an elastomeric material having a relatively low durometer rating. Alternatively, the flexible valve seat may be made of a relatively more rigid material but configured as a mechanical biasing element such as a wave spring, a bow spring, a flexible washer, etc. The flexible valve seat may be rotationally locked to the valve adapter via adhesive or a mechanical interlock such as a tongue-and-groove arrangement. Additionally, the flexible valve seat and corresponding outer surface of the valve body to which it is coupled may be tapered to assist with connecting the valve body to the flexible valve seat.

As an example, the stationary valve body may be connected to the stator housing through a stationary valve adapter and corresponding flexible valve seat configured to permit the stationary valve adapter to flex and thereby enter into angular misalignment with the stationary valve adapter. In this manner, the stationary valve body may flex in response to contact between the rotating and stationary valve bodies whereby the stationary valve body may maintain substantial angular alignment between the central axes of the rotating and stationary valve bodies. By permitting at least one of the pair of valve bodies to flex relative to its respective valve adapter, point loads applied to the pair of valve bodies may be minimized as the central axes of the pair of valve bodies remain substantially parallel during the operation of the agitator. In this manner, the flexible valve seat may reduce the degree of wear and fracture-related damage incurred by the pair of valve bodies and maximize the operational life of the pair of valve bodies.

Referring to FIG. 1, an embodiment of a well or drilling system 10 for drilling or producing hydrocarbons from a well or wellbore is shown. In this exemplary embodiment, drilling system 10 generally includes a vertical support structure or derrick 12 supported by a drilling platform 14. Platform 14 includes a drill deck or rig floor 16 supporting a rotary table 18 selectively rotated by a prime mover (not shown), such as an electric motor, controlled by a motor controller. Derrick 12 includes a traveling block 20 controlled by a drawworks 22 for raising and lowering a drillstring 24 suspended from traveling block 20. Drillstring 24 of drilling system 10 extends downward through the rotary table 18, a blowout preventer (BOP) stack 26, and into a wellbore 3 that extends into a subterranean earthen formation 5 along a central or longitudinal axis 15 from the surface 7. Drillstring 24 is formed from a plurality of drill pipe joints 28 connected end-to-end. In this exemplary embodiment, a bottom-hole-assembly (BHA) 30 is attached to the lowermost pipe joint 28 and a drill bit 32 is attached to the downhole end of BHA 30. In other embodiments, drilling system 10 may comprise an offshore drilling system that includes a drillstring that extends through a marine riser and into a subsea wellbore.

In this embodiment, drill bit 32 is rotated with rotary table 18 via drillstring 24 and BHA 30. By rotating drill bit 32 with weight-on-bit (WOB) applied thereto, the drill bit 32 disintegrates the subsurface formations to drill wellbore 3. In some embodiments, a top-drive may be used to rotate the drillstring 24 rather than rotation by the rotary table 18. In some applications, a downhole motor (mud motor) 35 is disposed in the drillstring 24 to rotate the drill bit 32 in lieu of or in addition to rotating the drillstring 24 from the surface 7. Particularly, the mud motor 35 may rotate the drill bit 32 when a drilling fluid passes through the mud motor 35 under pressure. In this exemplary embodiment, a casing string 34 is installed and extends downward generally from the surface 7 into at least a portion of wellbore 3. In some embodiments, casing string 34 is cemented within the wellbore 3 to isolate various vertically-separated earthen zones and prevent fluid transfer between the zones. BOP stack 26 is secured to the uphole end of casing string 34. Casing string 34 may comprise multiple tubular members, such as pieces of threaded pipe that are joined end-to end to form liquid-tight or gas-tight connections, to prevent fluid and pressure exchange between wellbore 3 and the surrounding earthen zone.

An annular space or annulus 36 is formed between both the sidewall 9 of wellbore 3 and drillstring 24 and between inner surface of casing string 34 and drillstring 24. In other words, annulus 36 extends through wellbore 3 and casing string 34. BOP stack 26 includes an annular space or flow path in fluid communication with annulus 36. An operator or drilling control system of drilling system 10 may selectively and controllably open and close one or more BOPs of BOP stack 26 to allow, to restrict, or to inhibit the flow of drilling fluid or another fluid through annulus 36. In this exemplary embodiment, drilling system 10 includes a drilling fluid circulation system to circulate drilling fluid or mud 40 down drillstring 24 and back up annulus 36. Drilling fluid 40 generally functions to cool drill bit 32, remove cuttings from the bottom of wellbore 3, and maintain a desired pressure or pressure profile in wellbore 3 during drilling operations. Drilling system further includes a drilling fluid reservoir or mud tank 42, a supply pump 44, a supply line 46 connected to the outlet of supply pump 44, and a kelly 48 for supplying drilling fluid 40 to the drillstring 24.

In this exemplary embodiment, along with drill pipe joints 28, drillstring 24 includes a friction reduction system 50 including a flexible agitator 100 and configured to reduce friction between drillstring 24 and the sidewall 9 of wellbore 3 while preventing or at least minimizing damage to a sidewall or mud cake of the wellbore 3. Although only a single friction reduction system 50 is shown in FIG. 1, in other embodiments, drilling system 10 may include a plurality of friction reduction systems 50 spaced along the drillstring 24. Additionally, while in this exemplary embodiment agitator 100 comprises a component of friction reduction system 50, in other embodiments, agitator 100 may not comprise a component of system 50 and instead may be associated with other equipment of drilling system 10. In this exemplary embodiment, drilling system 10 may be operated whereby drilling fluid 40 is pumped through drillstring 24 and to the mud motor 35 to rotate the drill bit 32. As mud motor 35 is operated to rotate drill bit 32, drillstring 24 may not be rotated at the surface by rotary table 18 and instead may axially slide through wellbore 3. Drilling fluid may be pumped at a drilling fluid pressure through friction reduction system 50 to induce axial oscillatory motion in drillstring 24 and thereby break static friction between drillstring 24 and the sidewall 9 of wellbore 3.

Figure 2:
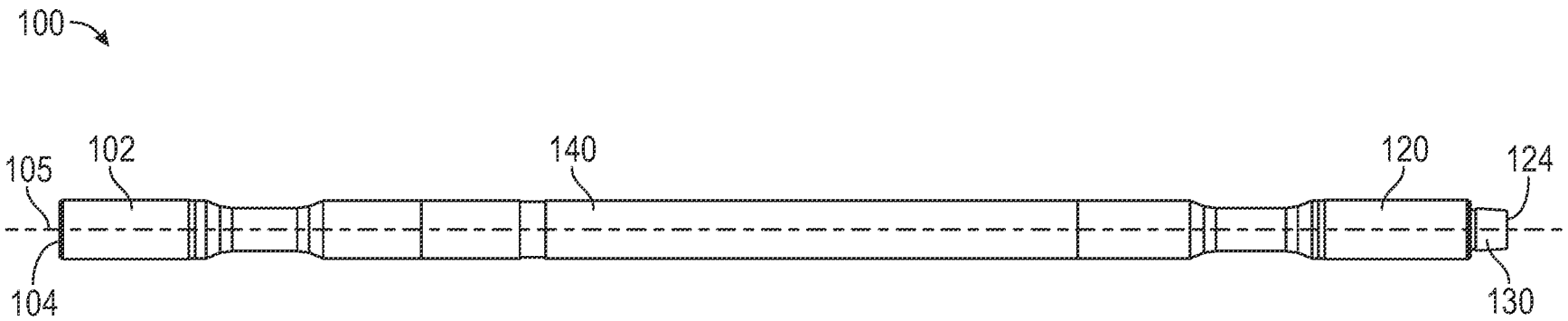
FIG. 2 is a side view of the agitator of FIG. 1.
Figure 3A:
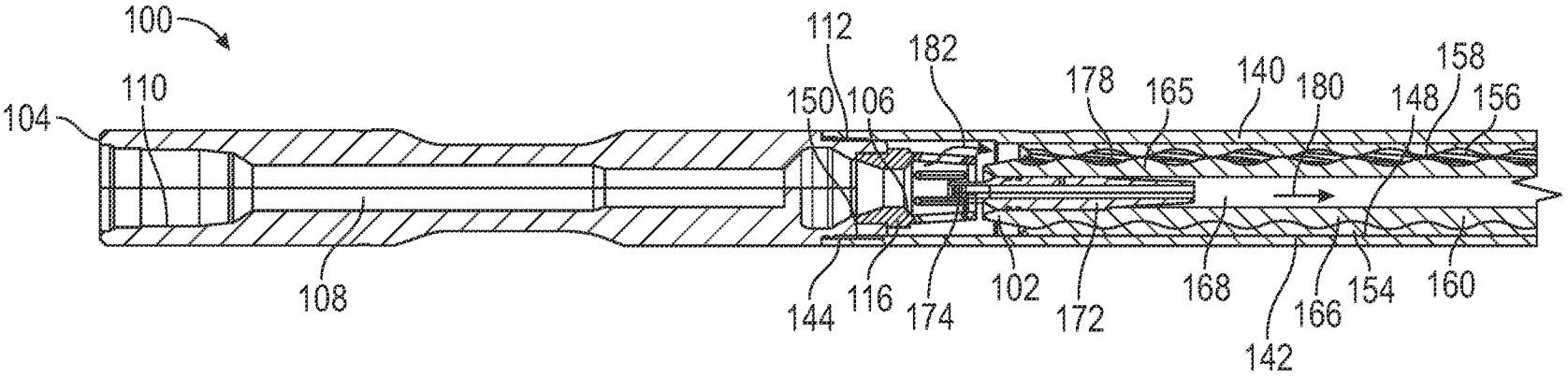
FIG. 3A is a side cross-sectional view of an uphole section of the agitator of FIG. 1.
Figure 3B:
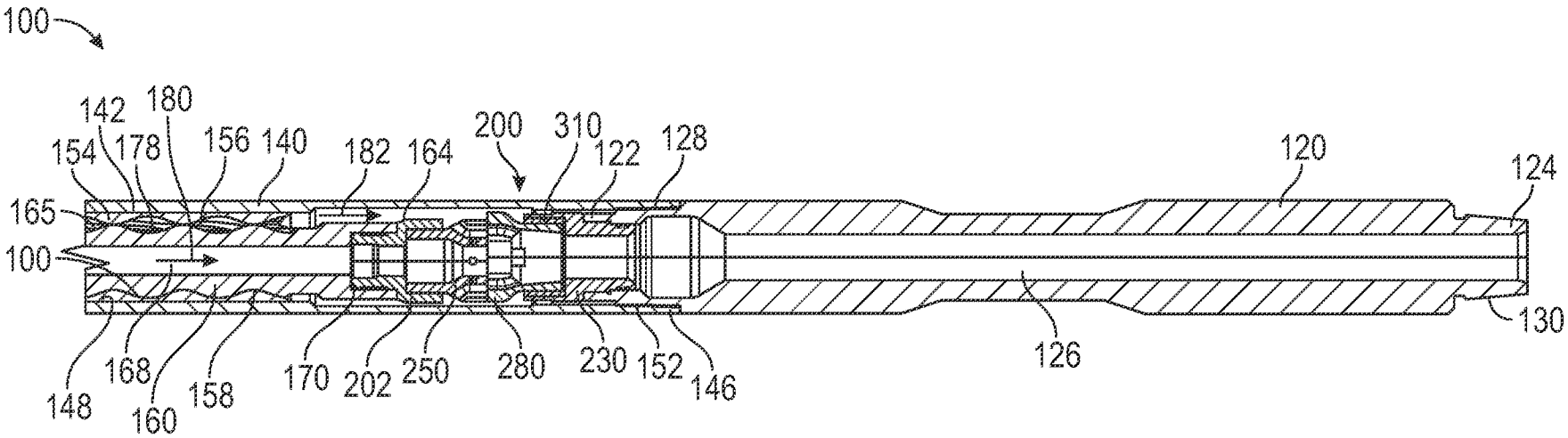
FIG. 3B is a side cross-sectional view of a downhole section of the agitator of FIG. 1.
Figure 4:
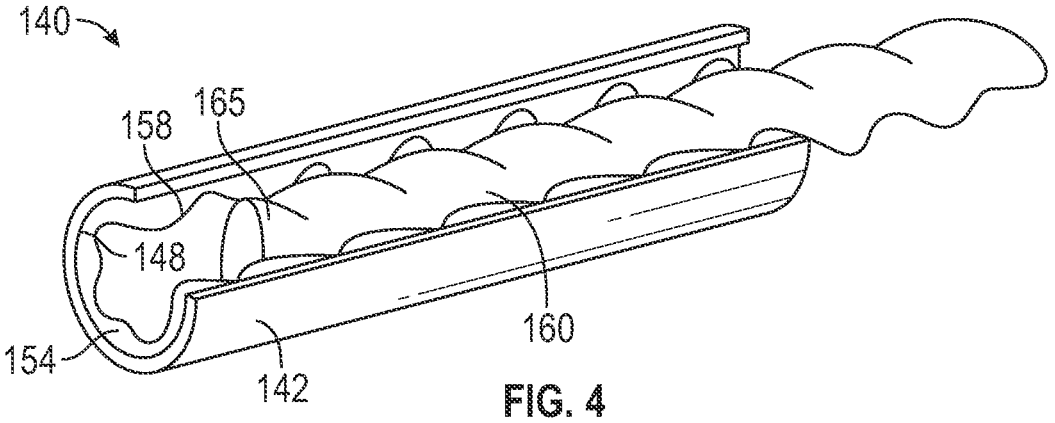
FIG. 4 is a perspective, partial cross-sectional view of a power sub of the agitator of FIG. 1 according to some embodiments.

Referring now to FIGS. 2, 3A, and 3B, an embodiment of the agitator 100 is shown. In this exemplary embodiment, agitator 100 has a central or longitudinal axis 105 and generally includes a first or top sub 102, a second or bottom sub 120 that is opposite top sub 102, a power sub or section 140, and a rotary valve 200. While not shown in FIGS. 2, 3A, and 3B, agitator 100 may be combined with a shock sub to form the friction reduction system 50 shown in FIG. 1. Alternatively, agitator 100 may be combined with equipment other than or in addition to a shock sub.

Top and bottom subs 102, 120 of agitator 100 may each couple agitator 100 to the drillstring 24. Top sub 102 includes a first or uphole end 104, a second or downhole end 106 that is opposite uphole end 104, and a central bore or passage 108 extending between ends 104, 106. Top sub 102 also includes an internal uphole connector 110 at the uphole end 104 thereof and formed on an inner surface of top sub 102. Uphole connector 110 may releasably or threadably connect to a drill pipe joint 28 of the drillstring 24 of drilling system 10 shown in FIG. 1. Top sub 102 further includes an external downhole connector 112 at the downhole end 106 thereof and formed on an outer surface of top sub 102. Downhole connector 112 may releasably or threadably connect to an uphole end of the power sub 140 of agitator 100.

In this exemplary embodiment, a dart guide 116 is connected to top sub 102 and projects outwardly from the downhole end 106 of top sub 102. Dart guide 116 includes a central bore or passage which gradually reduces in diameter moving from a first or uphole end of dart guide 116 connected to the downhole end 106 of top sub 102 to a second or downhole end that is opposite the uphole end of dart guide 116. Dart guide 116 additionally includes a plurality of circumferentially spaced radial openings or ports. Dart guide 116 is configured to guide a flow-transported obturating member or dart into the power sub 140 of agitator 100. Additionally, dart guide 116 may assist in routing a flow of drilling fluid through power sub 140 of agitator 100. Further, dart guide 116 may act as a rotor catch to prevent a rotor 160 of power sub 140 from backing up from and disengaging with a stator housing 142 of power sub 140. Further, it may be understood that in other embodiments, agitator 100 may not include dart guide 116.

Bottom sub 120 includes a first or uphole end 122, a second or downhole end 124 that is opposite uphole end 122, and a central bore or passage 126 extending between ends 122, 124. Bottom sub 120 also includes an external uphole connector 128 at the uphole end 122 thereof and formed on an outer surface of bottom sub 120. Uphole connector 128 may releasably or threadably connect to the power sub 140 of agitator 100 as will be discussed further herein. Bottom sub 120 further includes an external downhole connector 130 at the downhole end 124 thereof and formed on an outer surface of bottom sub 120. Downhole connector 130 may releasably or threadably connect to a drill pipe joint 28 of the drillstring 24 of drilling system 10.

Referring still to FIGS. 2, 3A, 3B, 4, and 5, power sub 140 of agitator 100 is generally configured to circulate drilling fluid in response to the pumping of drilling fluid 40 at the surface by supply pump 44 shown in FIG. 1 along a plurality of distinct flowpaths. In this exemplary embodiment, power sub 140 generally includes housing or stator housing 142 and rotor 160 rotatably disposed in the stator housing 142. Stator housing 142 has a central or longitudinal axis 145 (shown in FIG. 5) and includes first or uphole end 144, a second or downhole end 146, and a central passage defined by a generally cylindrical inner surface 148 extending between ends 144, 146. The inner surface 148 of stator housing 142 includes an internal first or uphole connector 150 positioned at uphole end 144 and which forms a first or uphole box end of stator housing 142. Uphole connector 150 is configured to threadably couple with the downhole connector 112 of top sub 102 to couple stator housing 142 with top sub 102. Additionally, an annular seal assembly may be positioned at the interface formed between the uphole end 144 of stator housing 142 and the downhole end 106 of top sub 102 to seal the connection formed therebetween.

The inner surface 148 of stator housing 142 additionally includes an internal second or downhole connector 152 positioned at downhole end 146 thereof, forming a second or downhole box end of stator housing 142. Downhole connector 152 of stator housing 142 may connect to the uphole connector 128 of bottom sub 120. In this exemplary embodiment, a helical-shaped elastomeric stator liner or insert 154 is formed on the inner surface 148 of stator housing 142. A helical-shaped inner surface 156 of stator insert 154 defines a plurality of stator lobes 158 (only a few of which are labeled in FIGS. 3A and 3B in the interest of clarity). In other embodiments, stator housing 142 may not include an insert and instead may comprise a single monolithically formed body.

In this exemplary embodiment, rotor 160 has a central or longitudinal axis 175 (shown in FIG. 5) and includes a first or uphole end 162, a second or downhole end 164 that is opposite uphole end 162, and a helical-shaped outer surface 165 extending between ends 162, 164 and which defines a plurality of rotor lobes 166 (only a few of which are labeled in FIGS. 3A and 3B in the interest of clarity) which intermesh with the stator lobes 158 of stator housing 142. Rotor 160 additionally includes a central bore or passage 168 extending entirely through the rotor 160 between ends 162, 164, and a downhole receptacle 170 extending into rotor 160 from the downhole end 164 thereof. As will be described further herein, in this exemplary embodiment, rotor 160 interfaces with the rotary valve 200 of agitator 100 via the downhole receptacle 170 thereof.

In this exemplary embodiment, agitator 100 may include a flow-transported obturating member or dart 172 (shown in FIG. 3A). Specifically, agitator 100, including subs 102, 120, power sub 140, and rotary valve 200, may initially be run into wellbore 3 along drillstring 24 without dart 172. Agitator 100 may then be operated within wellbore 3 to induce an oscillation in at least a portion of the drillstring 24. At some point during the operation of agitator 100, it may become desirable to adjust the frequency of the oscillation induced in drillstring 24 by agitator 100. Dart 172 may be flow-transported or pumped from the surface 7 through the drillstring 24 and landed within power sub 140 whereby agitator 100 may induce an oscillation in drillstring 24 at a second frequency that is different from the first frequency. It may be understood that dart 172 comprises an optional component which may not be pumped into power sub 140 during each use of agitator 100.

In this exemplary embodiment, dart 172 includes a dart nozzle 174 positioned within a central passage of the dart 172. An external landing profile 173 of dart 172 is configured to land against an internal landing profile formed on a cylindrical inner surface of the rotor 160 which defines the central passage 168 thereof. Dart 172 may additionally include a pair of annular seal assemblies formed on an outer surface thereof and configured to sealingly engage the inner surface of rotor 160 upon landing therein. The seal assemblies of dart 172 may restrict a flow of fluid across an annular interface formed between the inner surface of rotor 160 and the outer surface of dart 172. Additionally, in this exemplary embodiment, as dart 172 is pumped dart 172 is guided into the central passage 168 of rotor 160 by rotor guide 116. Particularly, the gradual reduction in diameter of the central passage of dart guide 116 centralizes dart 172 within power sub 140 to sufficiently align a central axis of dart 172 and the central axis of rotor 160 to permit dart 172 to enter central passage 168 of rotor 160. Dart guide 116 may also prevent rotor 160 from travelling uphole due to negative pressure which may occur following a wellbore kick.

Figure 5:
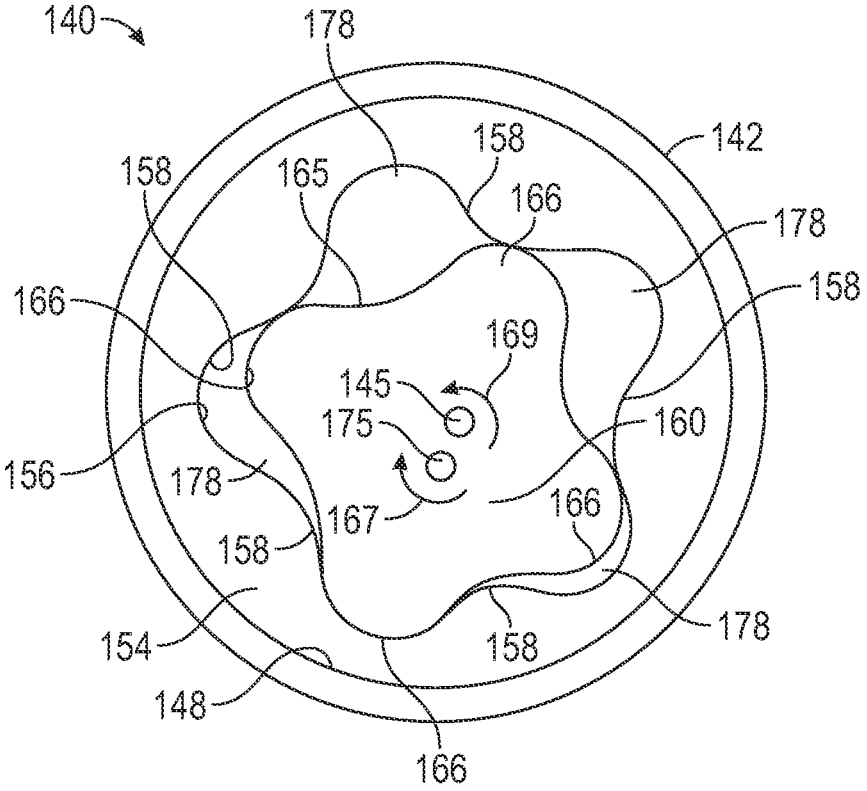
FIG. 5 is an end cross-sectional view of the power sub of FIG. 4.

As best shown in FIG. 5, in this exemplary embodiment, rotor 160 has one fewer lobe 166 than the stator housing 142. In this configuration, when rotor 160 and stator housing 142 are assembled, a series of cavities 178 are formed between the outer surface 165 of rotor 160 and the inner surface 156 of the stator insert 154 of stator housing 142. Each cavity 178 is sealed from adjacent cavities 178 by seals formed along the contact lines between stator housing 142 and rotor 160. Additionally, the central axis 175 of rotor 160 is radially offset from the central axis 145 of stator housing 142 by a fixed value known as the "eccentricity" of the rotor-stator assembly. Consequently, rotor 160 may be described as rotating eccentrically within stator housing 142.

In this exemplary embodiment, the assembly of stator housing 142 and rotor 160 forms a progressive cavity device, and particularly, a progressive cavity motor configured to transfer fluid pressure applied to the rotor-stator assembly into rotational torque applied to rotor 160. Specifically, during operation of agitator 100, drilling fluid 40 is pumped under pressure into an upstream end of the agitator 100. A first portion of the drilling fluid 40 entering agitator 100 flows along a first or first flowpath 180 extending through central passage 168 of rotor 160. A second portion of the drilling fluid 40 entering agitator 100 instead flows around central passage 168 of rotor 160 along a second flowpath 182 and into a first set of open cavities 178. A pressure differential across the adjacent cavities 178 forces rotor 160 to rotate relative to the stator housing 142. As rotor 160 rotates inside stator housing 142, adjacent cavities 178 are opened and filled with drilling fluid 40 flowing along second flowpath 182.

As this rotation and filling process repeats in a continuous manner, the drilling fluid 40 flowing along second flowpath 182 flows progressively down the length of stator housing 142 and continues to drive the rotation of rotor 160. Rotor 160 rotates about the central axis 175 of rotor 160 in a first rotational direction (indicated by arrow 167 in FIG. 5). Additionally, rotor 160 rotates about the central axis 145 of stator housing 142 in a second rotational direction (indicated by arrow 169 in FIG. 5) which is the opposite of the first rotational direction of arrow 167.

Referring now to FIGS. 3B, 6-11, additional views of valve 200 are provided in FIGS. 6-11. Rotary valve 200 of agitator 100 is configured to periodically apply the pressure of at least some of the drilling fluid 40 flowing through rotary valve 200 against bottom sub 120. The pressure pulses generated by rotary valve 200 may be applied to a shock sub to periodically generate oscillatory motion in the drillstring 24. In this exemplary embodiment, rotary valve 200 generally includes a first or uphole valve adapter 202, a second or downhole valve adapter 230, a first or uphole valve plate or body 250, a second or downhole valve plate or body 280, and a flexible valve seat 310.

Uphole valve adapter 202 receives the uphole valve body 250 and couples or secures the uphole valve body 250 to the rotor 160 of power sub 140 whereby relative rotation is restricted between uphole valve body 250 and rotor 160. As shown particularly in FIG. 6, uphole valve adapter 202 includes a first or uphole end 204, a second or downhole end 206 that is opposite uphole end 204, and a central bore or passage 208 extending between ends 204, 206. Uphole valve adapter 202 also includes an external uphole connector 210 at the uphole end 204 thereof and formed on an outer surface of uphole valve adapter 202. Uphole connector 210 may releasably or threadably connect to a downhole connector formed on the receptacle 170 of rotor 160 whereby uphole valve adapter 202 may be received and secured in the receptacle 170 to connect uphole valve adapter 202 with rotor 160. An annular seal assembly may be positioned at the interface formed between the receptacle 170 of rotor 160 and the uphole end 204 of uphole valve adapter 202 to seal the connection formed therebetween. Alternatively, a metal-to-metal seal may be formed directly between receptacle 170 and the uphole valve adapter 202. Uphole valve adapter 202 further includes a downhole receptacle 212 formed therein at the downhole end 206 thereof. Downhole receptacle 212 may receive a portion of the uphole valve body 250 to secure the valve body 250 to the uphole valve adapter 202. For example, the uphole valve adapter 202, with uphole valve body 250 received in downhole receptacle 212, may be shrink-fitted via heat shrinking onto the uphole valve body 250 to lock the uphole valve adapter 202 to the valve body 250. In other embodiments, various mechanisms and techniques may be used to connect uphole valve body 250 with the uphole valve adapter 202.

Downhole valve adapter 230 of rotary valve 200 has a central or longitudinal axis 235 and similarly includes a first or uphole end 232, a second or downhole end 234 that is opposite uphole end 232, and a central bore or passage 236 defined by a generally cylindrical inner surface 237 extending between ends 232, 234. Downhole valve adapter 230 also includes an uphole receptacle 238 therein at the uphole end 232 thereof. Uphole receptacle 238 may receive a portion of the downhole valve body 280 to secure the valve body 280 to the downhole valve adapter 230.

Downhole valve adapter 230 further includes an external downhole connector 240 at the downhole end 234 thereof and formed on an outer surface of downhole valve adapter 230. Downhole connector 240 may releasably or threadably connect to the uphole end 122 of bottom sub 120 to couple downhole valve adapter 230 and downhole valve body 280 to the bottom sub 120. An annular seal assembly may be positioned at the interface formed between the downhole end 234 of downhole valve adapter 230 and the uphole end 122 of bottom sub 120 to seal the connection formed therebetween. Additionally, as will be further described herein, the flexible valve seat 310 is also received in uphole receptacle 238 between the downhole valve adapter 230 and the portion of downhole valve body 280 received in receptacle 238. As will be further described herein, flexible valve seat 310 provides a flexible connection between downhole valve body 280 and downhole valve adapter 230 such that valve body 280 may flex relative to valve adapter 230 and the bottom sub 120 connected thereto.

Figure 6:
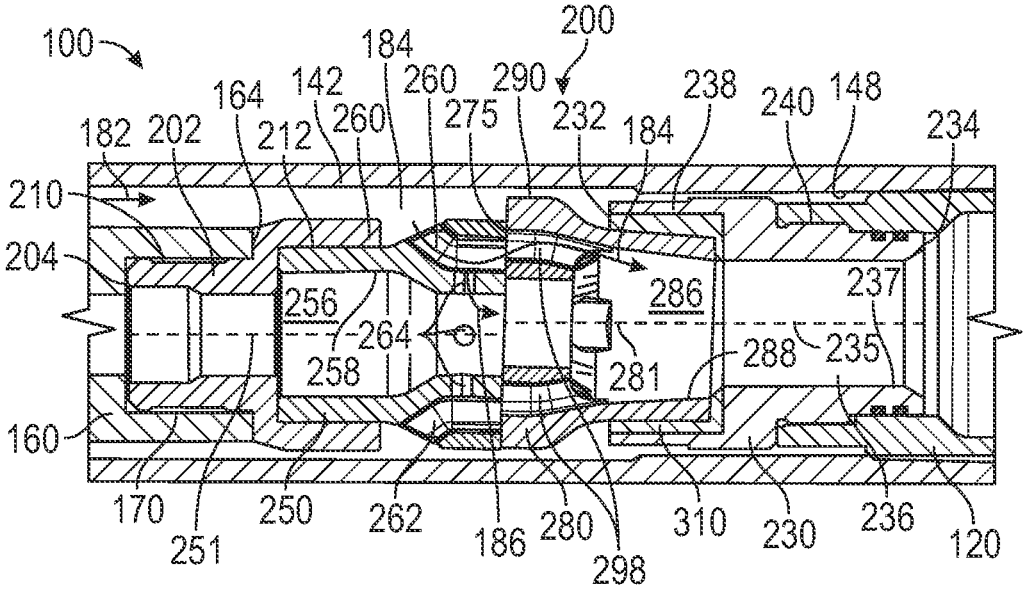
FIG. 6 is a zoomed-in side cross-sectional view of an embodiment of a rotary valve of the agitator of FIG. 1.
Figure 7:
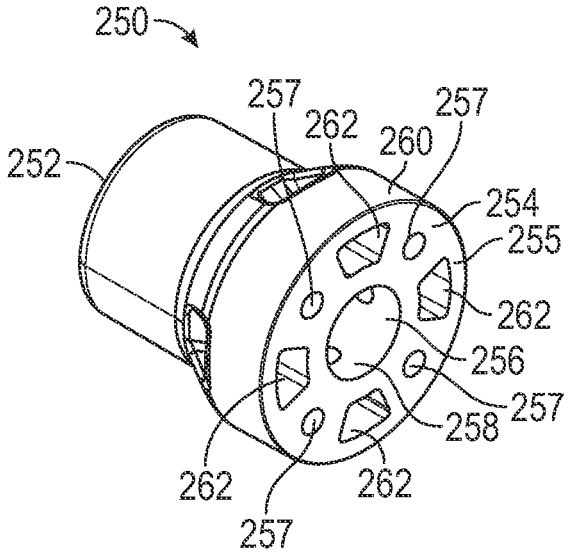
FIG. 7 is a perspective view of an embodiment of a first valve body of the rotary valve of FIG. 6.
Figure 8:
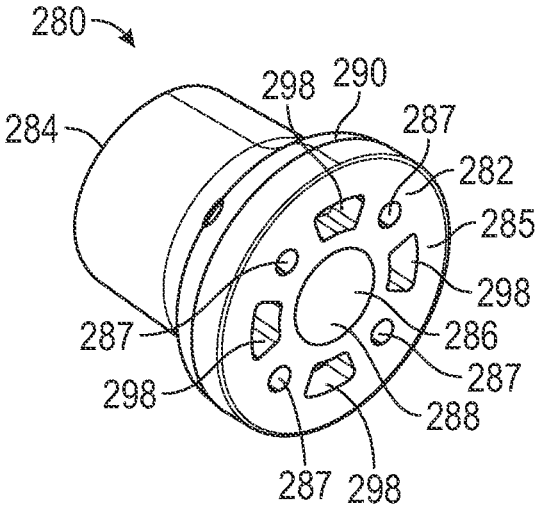
FIG. 8 is a perspective view of an embodiment of a second valve body of the rotary valve of FIG. 6.
Figure 9:
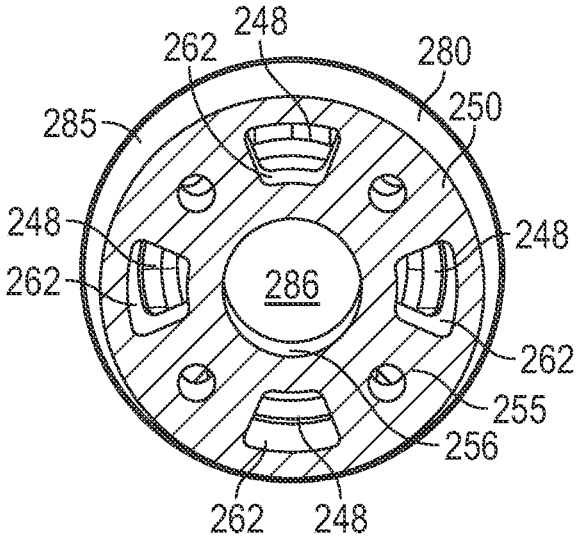
Figure 10:
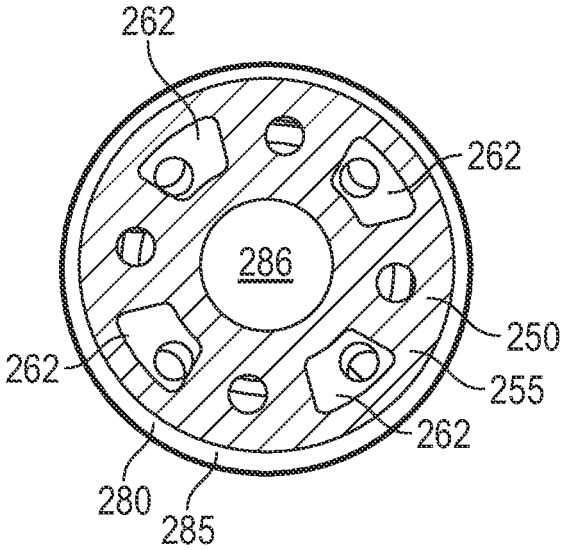
FIG. 10 is a schematic end view of the rotary valve of FIG. 6 in a closed configuration.

As shown particularly in FIGS. 6 and 7, uphole valve body 250 of rotary valve 200 has a central or longitudinal axis 251 (shown in FIG. 6) and generally includes a first or uphole end 252, a second or downhole end 254 that is opposite uphole end 252, a central bore or passage 256 defined by a generally cylindrical inner surface 258 extending between ends 252, 254, and a generally cylindrical outer surface 260 also extending between ends 252, 254. The downhole end 254 defines a generally planar downhole contact face 255 of the uphole valve body 250. In this exemplary embodiment, uphole valve body 250 additionally includes a plurality of circumferentially spaced uphole flow passages 262. Each uphole flow passage 262 extends from the downhole contact face 255 to the outer surface 260 of uphole valve body 250. As will be discussed further herein, uphole flow passages 262 may communicate with corresponding flow passages of downhole valve body 280 when a defined by the valve bodies 250 and 280 of rotary valve 200 is in an open configuration to maximize the flow area therethrough to minimize a pressure drop across the rotary valve 200. In this exemplary embodiment, one or more uphole cooling ports 257 are formed in and extend to the downhole contact face 255 of uphole valve body 250.

Additionally, in this exemplary embodiment, uphole valve body 250 includes a plurality of circumferentially spaced radial ports 264. Particularly, each radial port 264 is circumferentially aligned with a corresponding flow passage 262. In this configuration, each radial port 264 extends from a corresponding flow passage 262 to the central passage 256 of uphole valve body 250 thereby providing fluid communication between the flow passage 262 and the central passage 256.

Downhole valve body 280 of rotary valve 200 has a central or longitudinal axis 281 and generally includes a first or uphole end 282, a second or downhole end 284 that is opposite uphole end 282, a central bore or passage 286 defined by a generally cylindrical inner surface 288 extending between ends 282, 284, and a generally cylindrical outer surface 290 also extending between ends 282, 284. The uphole end 282 of downhole valve body 280 defines a generally planar uphole contact face 285 of the downhole valve body 280. As will be described further herein, a metal-to-metal seal is formed between the downhole contact face 255 of uphole valve body 250 and the uphole contact face 285 of downhole valve body 280 whereby relative rotation between valve bodies 250 and 280 results in rotary valve 200 cyclically shifting between the open and closed configurations. In this exemplary embodiment, one or more downhole cooling ports 287 (shown in FIG. 8) are formed in and extend to the uphole contact face 285 of downhole valve body 280. Downhole cooling ports 287 of downhole valve body 280 are in fluid communication with the uphole cooling ports 257 of uphole valve body 250. Cooling ports 257, 287 of valve bodies 250 and 280 retain fluid (e.g., drilling fluid) for cooling the valve bodies 250 and 280. It may be understood that in other embodiments the valve bodies 250 and 280 may not include cooling ports 257 and 287, respectively.

In this exemplary embodiment, downhole valve body 280 includes a plurality of circumferentially spaced downhole flow passages 298. Each downhole flow passage 298 extends from the uphole contact face 285 to the outer surface 290 of downhole valve body 280. As will be discussed further herein, downhole flow passages 298 may communicate with the corresponding uphole flow passages 262 of uphole valve body 250 when rotary valve 200 is in the open configuration while fluid communication directly between flow passages 262 and 298 is restricted when rotary valve 200 is in the closed configuration.

Uphole valve body 250 is positioned axially adjacent downhole valve body 280 whereby the downhole contact face 255 of uphole valve body 250 may contact the uphole contact face 285 of downhole valve body 280. In some embodiments, a generally planar metal-to-metal sealing interface 275 (shown in FIG. 6) is formed between the portion of downhole contact face 255 of uphole valve body 250 that is in contact with the uphole contact face 285 of downhole valve body 280 whereby fluid communication is restricted across the sealing interface 275. Valve bodies 250 and 280 may be formed from hardened materials configured to resist frictional wear such as, for example, tungsten-based materials such as tungsten carbide. In this exemplary embodiment, uphole valve body 250 is rotationally locked to rotor 160 of power sub 140 while downhole valve body 280 is generally rotationally locked to the stator housing 142 of power sub 140 (flexible valve seat 310 permitting a limited degree of movement between valve body 280 and stator housing 142).

Figure 11:
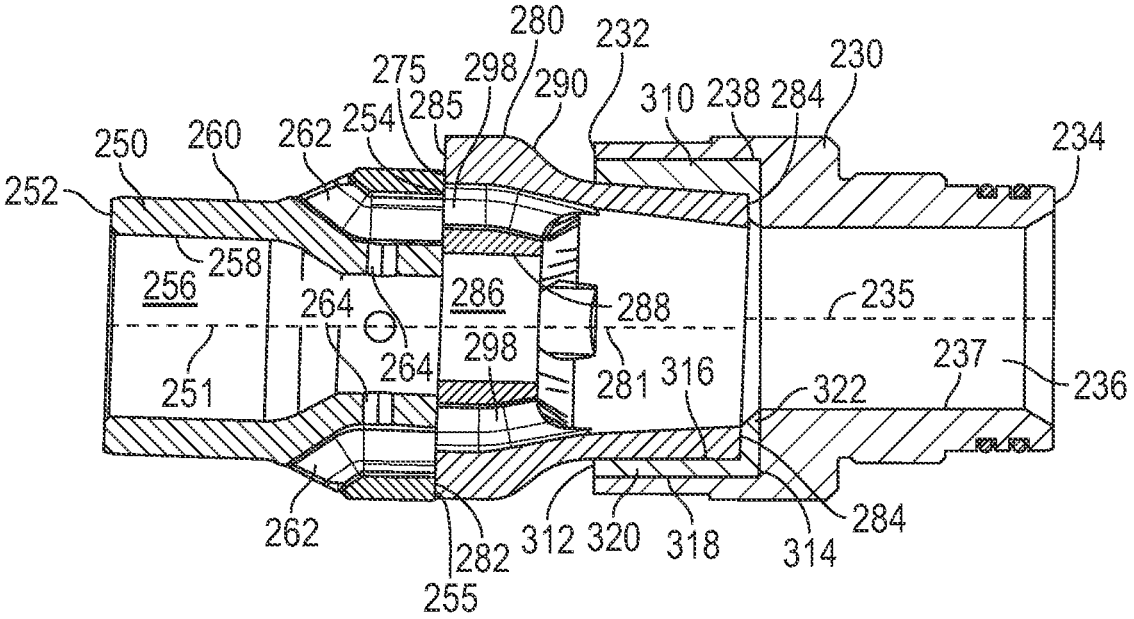
FIG. 11 is another side cross-sectional view of the rotary valve of FIG. 6.

As shown particularly in FIG. 11, downhole valve body 280 is connected to the downhole valve adapter 230 through the flexible valve seat 310 which permits a limited degree of relative movement between downhole valve body 280 and both the downhole valve adapter 230 and the bottom sub 120. Although in this exemplary embodiment it is downhole valve body 280 which is connected to flexible valve seat 310, in other embodiments, only uphole valve body 250 may be connected to flexible valve seat 310 while in still other embodiments each valve body 250 and 280 may be connected to a separate flexible valve seat. It may be understood that the rigidity of the flexible valve seat may be greater in embodiments in which each valve body 250 and 280 is connected to a separate flexible valve seat.

Flexible valve seat 310 is formed from a flexible material to permit a limited degree of relative movement or flex between the downhole valve body 280 and the downhole valve adapter 230. For example, in some embodiments, flexible valve seat 310 is formed from an elastomeric or rubber material. In some embodiments, flexible valve seat 310 comprises a material having a hardness on the Shore A Hardness scale of between approximately 40 and 120. In some embodiments, flexible valve seat 310 comprises a material having a hardness on the Shore A Hardness scale of between approximately 70 and 90. It may be understood that the hardness of flexible valve seat 310 may vary from the exemplary ranges listed above in other embodiments.

As shown particularly in FIG. 11, in this exemplary embodiment, flexible valve seat 310 includes a first or uphole end 312, a second or downhole end 314 that is opposite uphole end 312, and a central bore or passage defined by an inner surface 316 extending between ends 312 and 314, and an outer surface 318 also extending between ends 312 and 314. The inner surface 316 contacts and attaches to the outer surface 290 of downhole valve body 280 while the outer surface 318 of flexible valve seat 310 contacts and attaches to the inner surface 237 of downhole valve adapter 230. In this exemplary embodiment, inner surface 316 seals against outer surface 290 of downhole valve body 280 while outer surface 318 seals against inner surface 237 of downhole valve adapter 230, thereby sealing the connection between the downhole valve body 280 and downhole valve adapter 230.

In some embodiments, an adhesive such as a vulcanizing adhesive is located along the interface formed between the inner surface 316 of flexible valve seat 310 and the outer surface 290 of downhole valve body 280, and/or along the interface formed between the outer surface 318 of flexible valve seat 310 and the inner surface 237 of downhole valve adapter 230. The adhesive may assist in resisting relative rotation between downhole valve body 280 and downhole valve adapter 250 resulting from frictional contact between valve adapters 250 and 280 during the operation of agitator 100. In other embodiments, downhole valve body 280 may mechanically interlock with downhole valve adapter 250 to resist relative rotation therebetween. For example, downhole valve body 280 may include an external tongue that is interlockingly received in an internal groove of the downhole valve adapter 250 as part of a tongue-and-groove or dovetail-shaped arrangement.

In this exemplary embodiment, the flexible valve seat 310 includes a cylindrical portion or section 320 and an annular ledge or shoulder 322 located at the downhole end 314 thereof and extending radially inwards from the cylindrical section 310 of flexible valve seat 310. Deformation of the cylindrical section 320 and ledge 322 permit a limited degree of angular misalignment between the central axis 281 of downhole valve body 280 and the central axis 235 of downhole valve adapter 230.

In this exemplary embodiment, the inner surface 316 of flexible valve seat 310 is tapered along the longitudinal length of the cylindrical section 320 thereof such that an inner diameter (ID) of inner surface 316 decreases moving from the uphole end 312 thereof to the ledge 322. The taper of flexible valve seat 310 matches a taper formed along the portion of the outer surface 290 of downhole valve body 280 that is received in the uphole receptacle 238 of downhole valve adapter 230. In some embodiments, the taper formed along inner surface 316 of flexible valve seat 310 and the outer surface 290 of downhole valve body 280 is between approximately zero and 10°; however, the degree of taper along surfaces 290 and 316 may vary in other embodiments. The tapering of flexible valve seat 310 and downhole valve body 280 may strengthen the connection formed between downhole valve body 280 and flexible valve seat 310 such that the connection formed therebetween is less likely to be jeopardized or break during the operation of agitator 100.

Particularly, in some embodiments, a flexible material is compression molded with the downhole valve body 280 and downhole valve adapter 250 to form an assembly including the adapter 250, body 280, and flexible valve seat 310 with the body 280 and seat 310 each received in the uphole receptacle 328 of downhole valve adapter 250. For example, with the flexible material (e.g., an elastomeric material) first positioned in the uphole receptacle 328 of downhole valve adapter 230, the downhole end 284 of downhole valve adapter 280 is inserted into uphole receptacle 328. The downhole end 284 of downhole valve adapter 280 may then be compressed against the flexible material to form the flexible valve seat 310 and join the flexible valve seat 310 to both the downhole valve body 280 and the downhole valve adapter 230. However, it may be understood that flexible valve seat 310 may be formed, and the assembly of valve adapter 230, valve body 280, and flexible valve seat 310 may be assembled, using a variety of different techniques.

Figure 12:
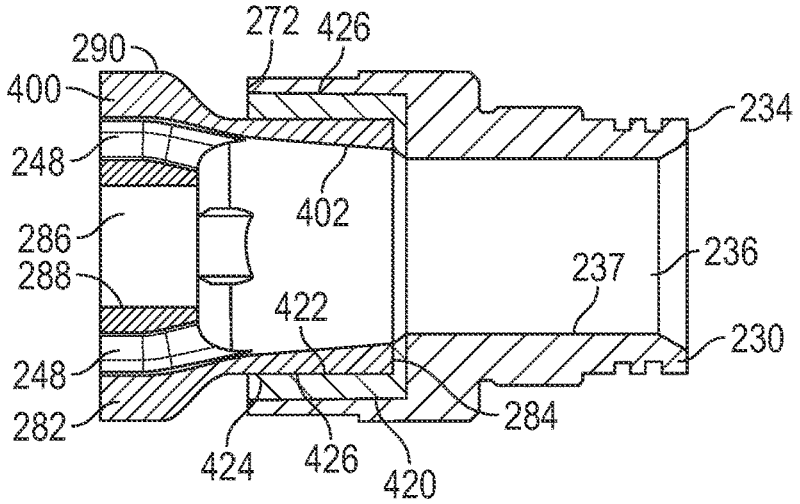
FIGS. 12-14 are side cross-sectional views of other embodiments of rotary valves.

Referring now to FIG. 12, another embodiment of a downhole valve body 400 and a flexible valve seat 420 are shown along with the downhole valve adapter 230. Downhole valve body 400 and flexible valve seat 420 share features in common with the downhole valve body 280 and flexible valve seat 310 described above, and shared features are labeled similarly. Particularly, downhole valve body 400 is similar to downhole valve body 280 and flexible valve seat 420 is similar to flexible valve seat 310 except that neither valve body 400 nor flexible valve seat 420 is tapered. Particularly, the portion of an outer surface 402 of downhole valve body 400 which is received in the uphole receptacle 238 of downhole valve adapter 230 is not tapered along its longitudinal length. Similarly, an inner cylindrical surface 422 of a cylindrical portion or section 424 of flexible valve seat 420 also does not taper along its longitudinal length.

Further, in this exemplary embodiment, the flexible valve seat 420 includes a plurality of circumferentially spaced pre-formed holes or openings 426. Particularly, openings 426 are formed in the cylindrical section 424 of flexible valve seat 420; however, it may be understood that in other embodiments the openings 426 may be formed in ledge 322 of flexible valve seat 420. Openings 426 provide space for the flexible material comprising flexible valve seat 420 to flow or deform into in response to the flexing of downhole valve body 400 relative to downhole valve adapter 230. The presence of such openings 426 may reduce the amount of stress and strain imparted to flexible valve seat 420 as downhole valve body 400 flexes and moves relative to downhole valve adapter 230.

Figure 13:
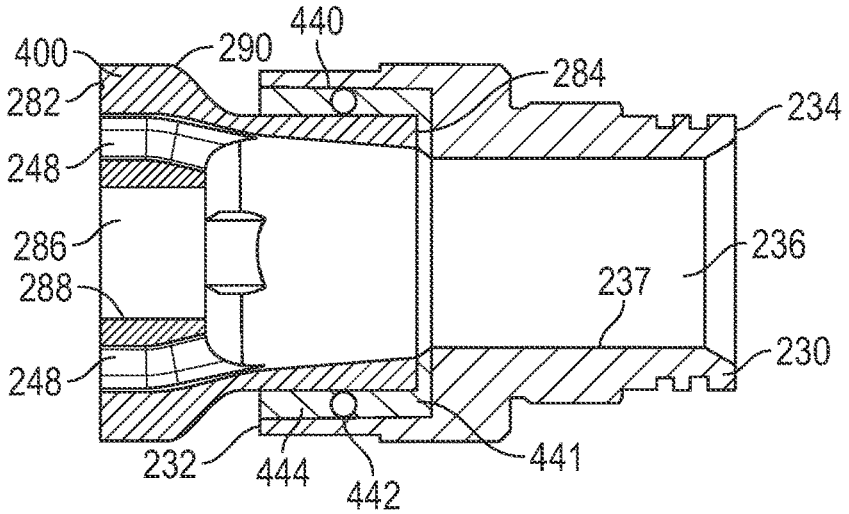

Referring now to FIG. 13, another embodiment of and a flexible valve seat 440 is shown along with downhole valve body 400 and downhole valve adapter 230. Flexible valve seat 440 share features in common with flexible valve seats 310 and 420 described above, and shared features are labeled similarly. Particularly, flexible valve seat 440 is similar to flexible valve seat 400 described above except that flexible valve seat 440 does not include openings 426 and instead includes a body 441 and an annular spacer ring 442 located or embedded within a cylindrical portion or section 444 of the body 41. In this configuration, spacer ring 442 extends entirely around the downhole valve body 400 and is oriented in a direction parallel a central axis of the downhole valve body 400. The body 441 may be formed from a first material (e.g., an elastomeric or other flexible material) while the spacer ring 442 may be formed from a second, rigid material that has a greater hardness than the first material.

Spacer ring 442 is formed from a rigid material and is configured to substantially prevent downhole valve body 400 from becoming laterally offset from downhole valve adapter 230 (where the central axis of body 400 becomes laterally spaced from the central axis 235 of downhole valve adapter 230) via interference between downhole valve body 400 and the spacer ring 442. Limiting the formation of a lateral offset between downhole valve body 400 and downhole valve adapter 230 may limit the stresses and strains to which the flexible valve seat 440 is subjected during operation and thus may extend the operational life of flexible valve seat 440 and/or downhole valve body 400. However, while intending to limit or prevent a lateral offset from forming between downhole valve body 400 and downhole valve adapter 230, spacer ring still permits a limited degree of angular misalignment between the central axis of valve body 400 and valve adapter 230.

Figure 14:
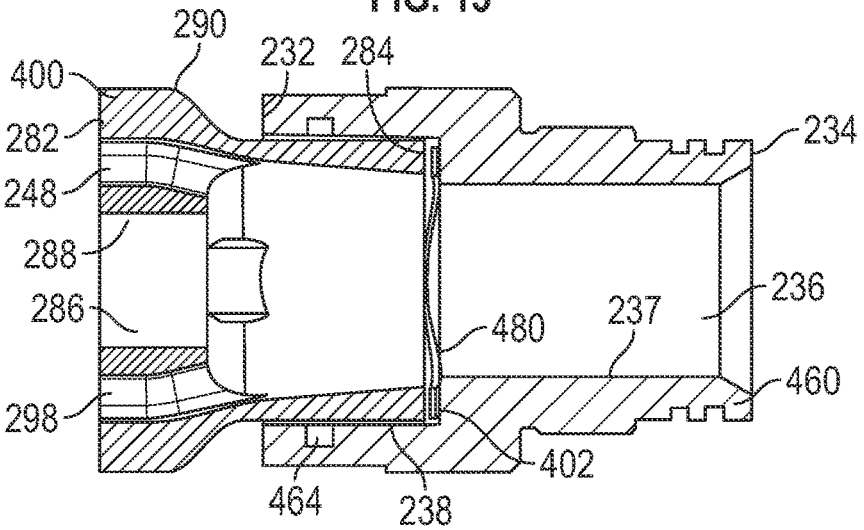

Referring now to FIG. 14, another embodiment of a downhole valve adapter 460 and a flexible valve seat 480 are shown along with the downhole valve body 400. Downhole valve adapter 460 and flexible valve seat 480 share features in common with the downhole valve adapter 230 and flexible valve seat 310 described above, and shared features are labeled similarly. Particularly, in this exemplary embodiment, flexible valve seat 480 comprises an annular, mechanical biasing member in the form of a wave spring or washer which acts against both the downhole end 284 of downhole valve body 400 and an annular ledge 462 of the downhole valve adapter 460 that is formed along the uphole receptacle 238 of valve adapter 460. In this exemplary embodiment, flexible valve seat 480 may be formed from a more rigid material (e.g., a metallic material or metal alloy) than the material comprising flexible valve seat 310 described above while still permitting a limited degree of angular misalignment between the central axis of downhole valve body 400 and the central axis 235 of downhole valve adapter 460.

Additionally, given that flexible valve seat 480 does not seal the connection formed between downhole valve body 300 and downhole valve adapter 460 in this exemplary embodiment, the downhole valve adapter 460 includes an annular seal assembly 464 positioned along the uphole receptacle 238 thereof which seals against the outer surface 290 of downhole valve body 460. In this configuration, seal assembly 464 seals the connection formed between downhole valve body 400 and the downhole valve adapter 460.

Referring now to FIGS. 1-3B, during operation of agitator 100 pressurized drilling fluid 40 may be pumped from supply pump 44 through drillstring 24, and into the top sub 102 of agitator 100. A first portion of the drilling fluid 40 entering agitator 100 flows along first flowpath 180 through central passage 168 of rotor 160, and into and through rotor nozzle 177 of power sub 140. A second portion of the drilling fluid 40, distinct from the first portion, flows along second flowpath 182 and into a first set of open cavities 178 formed between stator housing 142 and rotor 160. The flow of pressurized drilling fluid along second flowpath 182 induces rotation of rotor 160 about central axis 175 relative stator housing 142.

The rate of rotation of rotor 160 about central axis 175 is dependent on the amount of drilling fluid 40 diverted to the second flowpath 182. In turn, the amount of drilling fluid 40 diverted to the second flowpath relative to the amount of drilling fluid 40 flowing along first flowpath 180 may be controlled by the degree of flow restriction along flowpaths 180 and 182. Additionally, as described above, if desired dart 172 may be pumped through drillstring 24 and landed within central passage 168 of rotor 160. The landing of dart 172 within rotor 160 positions dart nozzle 174 along first flowpath 180 and thereby provides an additional flow restriction along first flowpath 180. The additional flow restriction provided by dart nozzle 174 increases the amount of drilling fluid 40 flowing along second flowpath 182 relative to first flowpath 180 and thereby increases the rotational rate of rotor 160 at a given flow rate of drilling fluid 40 entering power sub 140. The increase in the rotational rate of rotor 160 may increase the frequency of the pressure pulse generated by agitator 100.

Although in this exemplary embodiment power sub 140 is used to drive the relative rotation of valve bodies 250, 280, in other embodiments, agitator 100 may not include power sub 140 and instead a different mechanism may be utilized for providing relative rotation between valve bodies 250, 280. For example, an electric motor which may be driven by a battery, a generator, may be utilized to drive the rotation of uphole valve body 250. The downhole electric motor may be in communication with a downhole sensor package configured to determine the axial displacement of bottom sub 120. The electric motor may be controlled by a controller to achieve a desired magnitude or frequency of axial displacement of bottom sub 120 using the sensor package by adjusting the rotational rate of uphole valve body 250 relative to downhole valve body 280. In still other embodiments, power sub 140 may include a solid rotor that does not include a central passage extending therethrough.

Being rotationally locked to rotor 160, uphole valve body 250 also rotates about central axis 175 relative downhole valve body 280 which is held stationary relative to stator housing 142. Generally, in this manner the relative rotation between uphole valve body 250 and downhole valve body 280 corresponds to the rotational rate of rotor 160 relative to stator housing 142. As uphole valve body 250 rotates relative to downhole valve body 280, the flow passages 262 of uphole valve body 250 enter into and out of circumferential alignment or overlap with the flow passages 298 of downhole valve body 280. In the open configuration of rotary valve 200, fluid communication is provided directly between flow passages 262 of uphole valve body 250 and the flow passages 298 of downhole valve body 280. However, when rotary valve 200 is in the closed communication, fluid communication is restricted directly between flow passages 262 by the sealing interface 275 formed between valve bodies 250, 280. With uphole valve body 250 rotating relative to downhole valve body 280, rotary valve 200 cyclically actuates between the open and closed configurations at a rate that is dependent on the relative rotational speed between uphole valve body 250 and downhole valve body 280.

When rotary valve 200 is in the open configuration, a first portion of the drilling fluid 40 flowing along second flowpath 182 flows along a third flowpath 184 (shown in FIG. 6) extending from second flowpath 182 and which enters the flow passages 262 of uphole valve body 250, extends through the flow passages 298 of downhole valve body 280, and into the central passage 236 of downhole valve adapter 230. The drilling fluid 40 flowing along third flowpath 184 exits agitator 100 via the central passage 126 of bottom sub 120 where the drilling fluid 40 may be communicated to downstream components such as the portion of drillstring 24 positioned downstream from agitator 100 and the BHA 30 connected to the end of drillstring 24.

When rotary valve 200 is in the closed configuration, sealing contact between the contact faces 255 and 285 of valve bodies 250 and 280 prevent drilling fluid 40 from passing directly between flow passages 262 and 298 of valve bodies 250 and 280, respectively. Instead, drilling fluid 40 flowing along second flowpath 182 may only enter the central passage 236 of downhole valve adapter 230 via a fourth flowpath 186 (shown in FIG. 7) extending from the second flowpath 182, into the flow passages 262 of uphole valve body 250, and from flow passages 262 into the central passage 256 of valve body 250 via the plurality of radial ports 264 connected to flow passages 262. From central passage 256, drilling fluid 40 flowing along fourth flowpath 186 may continue through central passage 236 of downhole valve adapter 230 and from there may exit agitator 100 via the central passage 126 of bottom sub 120.

However, it may be understood that radial ports 264 have a smaller flow area than the flow passages 262 of uphole valve body 250. In this configuration, a minimum flow area through rotary valve 200 when rotary valve 200 is in the open configuration than a minimum flow area through rotary valve 200 when valve 200 is in the closed configuration. The difference in minimum flow areas of rotary valve 200 as valve 200 cycles between the open and closed configurations triggers the generation of a cyclical or repeating fluid or hydraulic pressure pulse emanating from the agitator 100 and which may be translated by a shock tool connected to agitator 100 into oscillating axial motion in the drillstring 26.

Further, due to misalignment between stator housing 142 and the stator insert 154 received therein, the central axis 175 of rotor 160 (rotor 160 being positioned within stator housing 142 by stator insert 154) may extend at a non-zero angle relative to a central axis of the stator housing 142. The magnitude of the angle formed between the central axis 175 of rotor 160 and the central axis of stator housing 145 may vary as rotor 160 rotates within the stator housing 142.

Misalignment between stator housing 142 and stator insert 154 may result due to an off-centered stator liner 154 produced by manufacturing tooling tolerances and process variations which naturally occur during the formation of the stator liner 154. Typically, the longitudinally opposed terminal ends of stator liner 154 (and other stator liners like stator liner 154) tend to be oppositely (approximately 180° apart) offset from a centerline of the stator liner 154. The offset of stator liner 154 (varying along the longitudinal length of liner 154) produces a corresponding offset in the rotor 160 positioned within stator liner 154 resulting in the angular misalignment between rotor 160 and stator housing 142. Additionally, given that uphole valve body 250 is secured to the downhole receptacle 170 of rotor 160, the central axis 251 of uphole valve body 250 is similarly positioned at a non-zero angle to the central axis of stator housing 142, where the magnitude of the non-zero angle may vary as uphole valve body 250 rotates relative to stator housing 142 in concert with rotor 160.

As described above, valve bodies 250 and 280 may be formed from hardened, wear resistant materials in order to resist the frictional contact which occurs between the contact faces 255 and 285 of valve bodies 250 and 280. However, such materials may be relatively brittle and susceptible to damage occurring in response to an elevated point load (an area of localized elevated stress and strain) applied to the hardened material. Additionally, angular misalignment between uphole valve body 250 and stator housing 142 without a corresponding angular misalignment between downhole valve body 280 and stator housing 142 may result in a corresponding angular misalignment between the central axes 251 and 281 of valve bodies 250 and 280, respectively. Such an angular misalignment between valve bodies 250 and 280 may result in only a small portion of the contact face 255 of uphole valve body 250 entering into contact with contact face 285 of downhole valve body 280 at a given time, resulting in-turn in a potentially damaging point load being applied to valve bodies 250 and 280 due to the angular misalignment therebetween.

However, as described above, flexible valve seat 310 of rotary valve 200 (as well as flexible valve seats 420, 440, and 480 shown in FIGS. 12-14) permits the central axis 281 of downhole valve body 280 to enter into a limited degree of misalignment with the central axis 235 of downhole valve adapter 230 (and thus with stator housing 142 as well with adapter 230 connected to housing 142 through bottom sub 120) in response to contact between valve bodies 250 and 280. For example, flexible valve seat 310 permits central axis 281 of downhole valve body 280 to enter into angular misalignment whereby central axis 281 extends at a non-zero, acute angle to central axis 235 (shown in FIG. 11). In some embodiments, flexible valve seat 310 permits a maximum angular misalignment between central axis 281 of downhole valve body 280 and central axis 235 of downhole valve adapter 235 that is between approximately 0.01° and 5.00°. In some embodiments, flexible valve seat 310 permits a maximum angular misalignment between central axis 281 of downhole valve body 280 and central axis 235 of downhole valve adapter 235 that is between approximately 2.00° and 4.00°. However, it may be understood that the degree of angular misalignment permitted by flexible valve seat 310 may vary.

The non-zero angle formed between the central axis 281 of downhole valve body 280 and the central axis 235 of downhole valve adapter 230 may result from contact between downhole valve body 280 and the uphole valve body 250 which, as described above, is misaligned with respect to the stator housing 142. The non-zero angle formed between the central axis 281 of downhole valve body 280 and the central axis 235 of downhole valve adapter 230 may thus substantially match or correspond to a corresponding non-zero angle formed between the central axis 251 of uphole valve body 250 and the central axis 235 of downhole valve adapter 230. In this manner, any angular misalignment between valve bodies 250 and 280 resulting from misalignment between uphole valve body 250 and stator housing 142 (e.g., due to an offset in the formation of stator liner 154) is automatically minimized (central axes 251 and 281 of valve bodies 250 and 280 remain substantially parallel) as downhole valve body 280 continuously flexes within downhole valve adapter 280 in response to the continuously varying misalignment occurring between uphole valve adapter 250 and stator housing 142 as adapter 250 rotates within housing 142.

The minimization in angular misalignment between the central axes 251 and 281 of valve bodies 250 and 280, respectively, in-turn minimizes point loads and associated maximum stresses and strains imparted to valve bodies 250 and 280 along contact faces 255 and 285, respectively, thereof. Instead, loads resulting from frictional contact between valve bodies 250 and 280 are spread relatively uniformly along the contact faces 255 and 295 of valve bodies 250 and 280, respectively. The reduction in point loads applied to the contact faces 258 and 285 of valve bodies 250 and 280 may reduce the possibility of damage occurring to valve bodies 250 and 280 during operation and thus may maximize the operational life of valve bodies 250 and 280.

While disclosed embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. An agitator deployable in a wellbore, comprising:

a housing comprising a central axis and a central passage;

a valve disposed in the housing and comprising a first valve body having a first contact face and a second valve body permitted to rotate relative to the first valve body and having a second contact face configured to contact the first contact face;

a first valve adapter coupled to the housing and which comprises a first receptacle which receives at least a portion of the first valve body to couple the first valve adapter to the first valve body, wherein the first receptacle comprises a cylindrical inner surface and an annular shoulder projecting radially inwards from the cylindrical inner surface; and a flexible valve seat positioned in the first receptacle of the first valve adapter between the first valve body and the first valve adapter, wherein the flexible valve seat has a cylindrical portion positioned radially between the first valve body and the cylindrical inner surface of the first receptacle and an annular shoulder extending radially inwards from the cylindrical portion and that is positioned axially between a longitudinal end of the first valve body and the annular shoulder of the first receptacle.

2. The agitator of claim 1, further comprising:

a stator positioned in the housing; and a rotor rotatably positioned in the stator and connected to one of the first valve body and the second valve body.

3. The agitator of claim 1, wherein the flexible valve seat is formed from an elastomeric material.

4. The agitator of claim 1, wherein the flexible valve seat is formed from a material having a durometer rating on the Shore A Hardness scale between 40 and 120.

5. The agitator of claim 1, wherein the flexible valve seat seals the connection formed between the first valve body and the first valve adapter.

6. The agitator of claim 1, further comprising:

a second valve adapter coupled to the housing and which comprises a second receptacle which receives at least a portion of the second valve body to couple the second valve adapter to the second valve body;

wherein the flexible valve seat comprises a first flexible valve seat and the agitator further comprises a second flexible valve seat positioned in the second receptacle of the second valve adapter and which seals the connection formed between the second valve body and the second valve adapter.

7. The agitator of claim 1, wherein the cylindrical portion of the flexible valve seat has a cylindrical inner surface that tapers in diameter along the longitudinal length of the cylindrical portion.

8. The agitator of claim 7, wherein the cylindrical portion of the flexible valve seat tapers such that an inner diameter of the inner surface of the flexible valve seat decreases moving from an uphole end of the flexible valve seat towards a downhole end of the flexible valve seat.

9. An agitator deployable in a wellbore, comprising:

a housing comprising a central axis and a central passage;

a valve disposed in the housing and comprising a first valve body having a first contact face and a second valve body permitted to rotate relative to the first valve body and having a second contact face configured to contact the first contact face;

a first valve adapter coupled to the housing and which comprises a first receptacle which receives at least a portion of the first valve body to couple the first valve adapter to the first valve body; and a flexible valve seat positioned in the first receptacle of the first valve adapter between the first valve body and the first valve adapter and wherein the flexible valve seat comprises a body formed from a first material having a first hardness and a spacer ring embedded in the body of the flexible valve seat that is formed from a second material having a second hardness that is greater than the first hardness.

10. The agitator of claim 9, wherein the material of the body of the flexible valve seat has a durometer rating on the Shore A Hardness scale between 70 and 90.

11. The agitator of claim 9, further comprising:

a stator positioned in the housing; and a rotor rotatably positioned in the stator and connected to one of the first valve body and the second valve body.

12. The agitator of claim 9, wherein the flexible valve seat seals the connection formed between the first valve body and the first valve adapter.

13. The agitator of claim 9, wherein the spacer ring extends entirely around the first valve body and is oriented in a direction parallel a central axis of the first valve body.

14. The agitator of claim 9, wherein the spacer ring restricts the first valve body from becoming laterally offset from the first valve adapter such that a central axis of the first valve body is laterally spaced from a central axis of the first valve adapter.

15. The agitator of claim 9, wherein:

the first receptacle of the first valve adapter comprises a cylindrical inner surface and an annular shoulder projecting radially inwards from the cylindrical inner surface; and the flexible valve seat has a cylindrical portion positioned radially between the first valve body and the cylindrical inner surface of the first receptacle and an annular shoulder extending radially inwards from the cylindrical portion and that is positioned axially between a longitudinal end of the first valve body and the annular shoulder of the first receptacle.

16. An agitator deployable in a wellbore, comprising:

a housing comprising a central axis and a central passage;

a valve disposed in the housing and comprising a first valve body having a first contact face and a second valve body permitted to rotate relative to the first valve body and having a second contact face configured to contact the first contact face;

a first valve adapter coupled to the housing and which comprises a first receptacle which receives at least a portion of the first valve body to couple the first valve adapter to the first valve body, wherein the first receptacle comprises a cylindrical inner surface and an annular shoulder projecting radially inwards from the cylindrical inner surface; and a flexible valve seat positioned in the first receptacle of the first valve adapter entirely between a longitudinal end of the first valve body and the annular shoulder of the first receptacle.

17. The agitator of claim 16, further comprising:

a stator positioned in the housing; and a rotor rotatably positioned in the stator and connected to one of the first valve body and the second valve body.

18. The agitator of claim 16, wherein the flexible valve seat comprises a mechanical biasing member configured to apply a biasing force to the longitudinal end of the first valve body.

19. The agitator of claim 16, wherein the flexible valve seat comprises a wave spring.

20. The agitator of claim 16, wherein the flexible valve seat is trapped axially between the longitudinal end of the first valve body and the annular shoulder of the first receptacle.

* * * * *